US011373472B2

(12) United States Patent
Hadzic et al.

(10) Patent No.: US 11,373,472 B2
(45) Date of Patent: Jun. 28, 2022

(54) COMPACT ENCODING OF STATIC PERMISSIONS FOR REAL-TIME ACCESS CONTROL

(71) Applicant: Carrier Corporation, Palm Beach Gardens, FL (US)

(72) Inventors: Tarik Hadzic, Cork (IE); Guoda Kaminske, Vilnius (LT); Blanca Florentino, Cork (IE); Menouer Boubekeur, Cork (IE); Ankit Tiwari, Framingham, MA (US); Ed Gauthier, Fairport, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/489,937

(22) PCT Filed: Feb. 21, 2018

(86) PCT No.: PCT/US2018/018954
§ 371 (c)(1),
(2) Date: Aug. 29, 2019

(87) PCT Pub. No.: WO2018/160407
PCT Pub. Date: Sep. 7, 2018

(65) Prior Publication Data

US 2019/0392658 A1 Dec. 26, 2019

Related U.S. Application Data

(60) Provisional application No. 62/465,572, filed on Mar. 1, 2017.

(51) Int. Cl.
*G07C 9/27* (2020.01)

(52) U.S. Cl.
CPC ..... *G07C 9/27* (2020.01)

(58) Field of Classification Search
CPC .. G07C 9/27; G07C 9/00571; G07C 9/00158; G06Q 20/127; G05B 15/02
(Continued)

(56) References Cited

U.S. PATENT DOCUMENTS 6,233,588 B1 5/2001 Marchoili et al.
6,748,343 B2 6/2004 Alexander et al.
(Continued)

FOREIGN PATENT DOCUMENTS

CN 203102415 U 7/2013
CN 103839313 A 6/2014
(Continued)

OTHER PUBLICATIONS

Assa Abloy, "Smartair Update on Card", available at: https://www.assaabloyopeningsolutions.nz/Local/NZ/Products/Access%20Control/SMARTair/Update%20on%20Card/PDF/Downloads/SMARTair%20Update%20On%20Card.pdf, accessed Aug. 27, 2019, 7 pages.
(Continued)

*Primary Examiner* — Vernal U Brown
(74) *Attorney, Agent, or Firm* — Cantor Colburn LLP

(57) ABSTRACT

A physical access control system (PACS) for protecting a resource. The PACS includes a credential including information regarding a user stored thereon, the credential presented to request access to a resource protected by an access point. A reader is in operative communication with the credential and configured to read the user information from the credential. The user information includes at least one attribute. A controller executes a set of access control rules, the rules based on policies extracted from a database of static permissions for the user, the policies defining requirements for permitting access of the user to the resource based on the at least one attribute, the controller configured to permit access to the resource.

24 Claims, 4 Drawing Sheets

(58) Field of Classification Search
USPC ..... 340/5.6
See application file for complete search history.

(56) References Cited

U.S. PATENT DOCUMENTS

| | | | | |
|---|---|---|---|---|
| 7,016,813 | B2 | 3/2006 | Alexander et al. | |
| 7,136,711 | B1 | 11/2006 | Duncan et al. | |
| 7,650,633 | B2 | 1/2010 | Whitson | |
| 7,752,652 | B2 | 7/2010 | Prokupets et al. | |
| 7,818,783 | B2 | 10/2010 | Davis | |
| 7,944,469 | B2 | 5/2011 | Barker | |
| 7,945,670 | B2 | 5/2011 | Nakamura et al. | |
| 8,009,013 | B1 | 8/2011 | Hirschfeld et al. | |
| 8,015,597 | B2 | 9/2011 | Libin et al. | |
| 8,108,914 | B2 | 1/2012 | Hernoud et al. | |
| 8,160,307 | B2 | 4/2012 | Polcha et al. | |
| 8,166,532 | B2 | 4/2012 | Chowdhury et al. | |
| 8,234,704 | B2 | 7/2012 | Ghai et al. | |
| 8,302,157 | B2 | 10/2012 | Smith | |
| 8,321,461 | B2 | 11/2012 | Hinojosa et al. | |
| 8,370,911 | B1 | 2/2013 | Mallard | |
| 8,464,161 | B2 | 6/2013 | Giles et al. | |
| 8,533,814 | B2 | 9/2013 | Neely | |
| 8,763,069 | B2 | 6/2014 | Renfro et al. | |
| 8,793,790 | B2 | 7/2014 | Khurana et al. | |
| 8,836,470 | B2 | 9/2014 | Pineau et al. | |
| 8,907,763 | B2 | 12/2014 | Pineau et al. | |
| 9,077,728 | B1 | 7/2015 | Hart et al. | |
| 9,111,088 | B2 | 8/2015 | Ghai et al. | |
| 9,118,656 | B2 | 8/2015 | Ting et al. | |
| 9,189,623 | B1 | 11/2015 | Lin et al. | |
| 9,189,635 | B2 | 11/2015 | Hori et al. | |
| 9,231,962 | B1 | 1/2016 | Yen et al. | |
| 9,237,139 | B2 | 1/2016 | Shaikh | |
| 9,264,449 | B1 | 2/2016 | Roth et al. | |
| 9,311,496 | B1 | 4/2016 | Dutch et al. | |
| 9,400,881 | B2 | 7/2016 | Hernoud et al. | |
| 9,418,236 | B2 | 8/2016 | Cabrera et al. | |
| 9,600,340 | B1 * | 3/2017 | Mundar | G06F 9/5038 |
| 9,923,927 | B1 * | 3/2018 | McClintock | H04L 63/108 |
| 10,430,594 | B2 * | 10/2019 | Florentino | G06F 21/6218 |
| 2002/0026592 | A1 | 2/2002 | Gavrila et al. | |
| 2002/0162005 | A1 | 10/2002 | Ueda et al. | |
| 2003/0126465 | A1 | 7/2003 | Tassone et al. | |
| 2004/0083394 | A1 | 4/2004 | Brebner et al. | |
| 2004/0153671 | A1 | 8/2004 | Schuyler | |
| 2005/0099288 | A1 | 5/2005 | Spitz et al. | |
| 2006/0064486 | A1 * | 3/2006 | Baron | H04L 41/5019 709/224 |
| 2007/0073519 | A1 | 3/2007 | Long | |
| 2007/0272744 | A1 | 11/2007 | Bantwal et al. | |
| 2008/0086758 | A1 | 4/2008 | Chowdhury et al. | |
| 2008/0209506 | A1 | 8/2008 | Ghai et al. | |
| 2008/0313556 | A1 | 12/2008 | Zhang et al. | |
| 2010/0023249 | A1 | 1/2010 | Mays et al. | |
| 2010/0241668 | A1 | 9/2010 | Susanto et al. | |
| 2011/0148633 | A1 | 6/2011 | Kohlenberg et al. | |
| 2011/0162058 | A1 | 6/2011 | Powell et al. | |
| 2011/0221565 | A1 | 9/2011 | Ludlow et al. | |
| 2011/0246527 | A1 | 10/2011 | Bitting et al. | |
| 2011/0254664 | A1 | 10/2011 | Sadr et al. | |
| 2012/0054826 | A1 | 3/2012 | Asim et al. | |
| 2012/0084843 | A1 | 4/2012 | Hernoud et al. | |
| 2012/0169457 | A1 | 7/2012 | Williamson | |
| 2012/0311696 | A1 * | 12/2012 | Datsenko | G06F 21/6218 726/17 |
| 2013/0091539 | A1 | 4/2013 | Khurana et al. | |
| 2014/0033271 | A1 | 1/2014 | Barton et al. | |
| 2014/0147801 | A1 | 5/2014 | Yasuda | |
| 2014/0282929 | A1 | 9/2014 | Tse | |
| 2015/0200925 | A1 | 7/2015 | Lagerstedt et al. | |
| 2015/0220711 | A1 | 8/2015 | Lowe | |
| 2015/0350902 | A1 | 12/2015 | Baxley et al. | |
| 2016/0210455 | A1 | 7/2016 | Lee et al. | |
| 2016/0219492 | A1 | 7/2016 | Jung | |
| 2016/0308859 | A1 | 10/2016 | Barry et al. | |
| 2017/0076523 | A1 * | 3/2017 | Rumble | G06Q 20/127 |
| 2017/0098095 | A1 | 4/2017 | Gilpin | |
| 2017/0236347 | A1 | 8/2017 | Drako et al. | |
| 2019/0392657 | A1 | 12/2019 | Hadzic et al. | |
| 2020/0020182 | A1 | 1/2020 | Florentino et al. | |
| 2020/0028877 | A1 | 1/2020 | Tiwari et al. | |
| 2020/0074338 | A1 | 3/2020 | Florentino et al. | |

FOREIGN PATENT DOCUMENTS

| | | | |
|---|---|---|---|
| CN | 104040595 | A | 9/2014 |
| CN | 104380351 | A | 2/2015 |
| EP | 1646937 | B1 | 6/2011 |
| EP | 2348438 | A1 | 7/2011 |
| EP | 2732579 | A1 | 5/2014 |
| EP | 2866485 | A1 | 4/2015 |
| EP | 2889812 | A1 | 7/2015 |
| GB | 2493078 | A | 1/2013 |
| JP | 3120555 | U | 4/2006 |
| JP | 2006183398 | A | 7/2006 |
| WO | 0214989 | A2 | 2/2002 |
| WO | 2007089503 | A2 | 8/2007 |
| WO | 2012090189 | A1 | 7/2012 |
| WO | 2013098910 | A1 | 7/2013 |
| WO | 2015065377 | A1 | 5/2015 |
| WO | 2015099607 | A1 | 7/2015 |
| WO | 2016064470 | A1 | 4/2016 |

OTHER PUBLICATIONS

Axiomatics, "Attribute Based Access Control Beyond Roles", available at: https://www.axiomatics.com/blog/attribute-based-access-control-beyond-roles-1/, Aug. 2016, 4 pages.

Biuk-Aghai, Robert P. et al., "Security in Physical Environments: Algorithms and System for Automated Detection of Suspicious Activity", Department of Computer and Information Science, University of Macau, Macau, 2010, 13 pages.

Colantonio, Alessandro, "A Cost-Driven Approach to Role Engineering", In Proceedingsof the 23rd ACM Symposium on Applied Computing, SAC '08, vol. 3, 2008, pp. 2129-2136.

Colantonio, Alessandro, et al., "Mining Stable Roles in RBAC", In Proceedings of the IFIP TC 11 24th International Information Security Conference, SEC '09, 2009, pp. 259-269.

Fitzgerald, William, M., et al., "Anomaly Analysis for Physical Access Control Security Configuration", University College Cork, 2012, 8 pages.

Fong, Simon et al., "A Security Model for Detecting Suspicious Patterns in Physical Environment", Abstract, Third International Symposium on Information Assurance and Security, Aug. 2007, 1 page.

Gupta, Rohit, et al., "Quantitative Evaluation of Approximate Frequent Pattern Mining Algorithms", In Proceedings of the 14th ACM SIGKDD International Conference on Knowledge Discovery and Data Mining, 2008, pp. 301-309.

International Search Report and Written Opinion for application PCT/US2018/018958, dated May 18, 2018, 20 pages.

International Search Report and Written Opinion for application PCT/US2018/020216, dated May 7, 2018, 11 pages.

International Search Report and Written Opinion for application PCT/US2018/020219, dated Jun. 5, 2018, 16 pages.

International Search Report and Written Opinion for application PCT/US2018/18954, dated May 29, 2018, 14pages.

International Search Report for application PCT/US2018/019950, dated Jun. 4, 2018, 15 pages.

Maybury, Mark, "Detecting Malicious Insiders in Military Networks", The MITRE Corporation, 2006, 7 pages.

Metoui, N., et al., "Trust and Risk-Based Access Control for Privacy Preserving Threat Detection Systems", Abstract, International Conference on Future Data and Security Engineering, 2016, 9 pages.

West, Andrew, et al., "Mitigating Spam Using Spatio-Temporal Reputation", University of Pennsylvania, 2010, 22 pages.

Yan, Pengfan, et al., "Detection of Suspicious Patterns in Secure Physical Environments", Department of Computer and Information Science, Faculty of Science and Technology, University of Macau, Nov. 30, 2006, 6 pages.

(56) References Cited

OTHER PUBLICATIONS

Yen, Ting-Fang, et al., "Beehive: Large-Scale Log Analysis for Detecting Suspicious Activity in Enterprise Networks", ACSAC 2013, 10 pages.
Zhang, Dana, et al., "Efficient Graph Based Approach to Large Scale Role Engineering", Transactions on Data Privacy 7 (2014), pp. 1-26.
U.S. Non-Final Office Action for U.S. Appl. No. 16/490,295; dated Jun. 17, 2020; 28 Pages.
U.S. Non-Final Office Action for U.S. Appl. No. 16/489,993; dated Feb. 4, 2021; 31 Pages.
U.S. Final Office Action for U.S. Appl. No. 16/489,993; dated Aug. 5, 2021; 16 Pages.
Chinese Office Action for Application No. 201880015025.5; dated Apr. 14, 2021; 12 Pages.

* cited by examiner

| USER ID | USER ROLE | ALLOWED PERMISSIONS |
|---|---|---|
| 1 | MANAGER | P1, P2, P3 |
| 2 | EMPLOYEE | P1 |
| 3 | EMPLOYEE | P1 |
| 4 | EMPLOYEE | P1 |
| 5 | MANAGER | P1, P2, P3 |

RESOURCE RULES FOR P1:
IF ROLE = "MANAGER" OR ROLE="EMPLOYEE" ALLOW ACCESS

RESOURCE RULES FOR P2 AND P3:
IF ROLE = "MANAGER" ALLOW ACCESS
IF ROLE ≠ "MANAGER" DENY ACCESS

155

FIG. 3

COMPACT ENCODING OF STATIC PERMISSIONS FOR REAL-TIME ACCESS CONTROL

TECHNICAL FIELD

The subject matter disclosed herein relates generally to physical access control systems (PACS), and more particularly to how PACS decide to grant access to a credential holder when presenting the credential.

BACKGROUND

Physical access control systems (PACS) prevent unauthorized individuals access to protected areas. Individuals who have a credential (e.g., card, badge, RFID card, FOB, or mobile device) present it at an access point (e.g., swipe a card at a reader) and the PACS makes an almost immediate decision whether to grant them access (e.g., unlock the door). The decision is usually computed at a nearby controller by checking a permissions database to ascertain whether there is a static permission linked to requester's credential. If the permission(s) are correct, the PACS unlocks the door as requested providing the requestor access. Typically, with static permissions, such a request for access can be made at a given time of the day. In standard deployment of a PACS, a permission(s) database is maintained at a central server and relevant parts of the permissions database are downloaded to individual controllers that control the locks at the doors.

However, database of permissions can be large especially as the scale of an enterprise grows large. Such large databases can consume significant amounts of memory on a controller. Moreover, because of the size of the database, it can be very time consuming to update controllers by downloading databases from the central server to controllers every time there is a change in any permission(s), credential, controller, or users. Such deployments therefore require more costly installations, by either installing more powerful controllers or larger number of controllers.

BRIEF SUMMARY

According to an exemplary embodiment, described herein A physical access control system (PACS) for protecting a resource The PACS including a credential including information regarding a user stored thereon, the credential presented to request access to a resource protected by an access point, a reader in operative communication with the credential and configured to read the user information from the credential, wherein the user information includes at least one attribute, and a controller executing a set of access control rules, the rules based on policies extracted from a database of static permissions for the user, the policies defining requirements for permitting access of the user to the resource based on the at least one attribute, the controller configured to permit access to the resource.

In addition to one or more of the features described above or below, or as an alternative, further embodiments could include the controller receiving context based information from at least one of the reader, the a door controller, server, cloud, other controllers, or an administrator.

In addition to one or more of the features described above or below, or as an alternative, further embodiments could include that the executing is based on the context based information.

In addition to one or more of the features described above or below, or as an alternative, further embodiments could include that the context based information includes information regarding attributes specific to or associated with access to the resource.

In addition to one or more of the features described above or below, or as an alternative, further embodiments could include that context based information includes at least one of occupancy of a resource, a maximum occupancy of a resource, a time based constraint, a user based constraint, user history, a PACS constraint, a building system parameters, a parameter of other building systems, and external criteria.

In addition to one or more of the features described above or below, or as an alternative, further embodiments could include that the credential is at least one of a badge, a magnetic card, an RFID card, a smart card, a FOB, and a mobile device.

In addition to one or more of the features described above or below, or as an alternative, further embodiments could include that the attribute is specific to the user.

In addition to one or more of the features described above or below, or as an alternative, further embodiments could include that wherein the attribute is generic to a group of users.

In addition to one or more of the features described above or below, or as an alternative, further embodiments could include that the attribute is at least one of a user's role, a user's department, a user's export control status, a user's certification/training status, a badge type, and a credential ID.

In addition to one or more of the features described above or below, or as an alternative, further embodiments could include that the controller executes the policy on controller using standard Attribute-Based Access Control policy execution mechanisms.

In addition to one or more of the features described above or below, or as an alternative, further embodiments could include that the controller executes the policy based on an IF-CONDITION-THEN-ACTION rule, wherein each condition of the rule is a logical relationship over user and resource attribute values and action of the rule is to permit or deny access to the resource.

In addition to one or more of the features described above or below, or as an alternative, further embodiments could include that the controller executes the rules in a compiled knowledge representation format using graphical traversal algorithms.

In addition to one or more of the features described above or below, or as an alternative, further embodiments could include that the system computes a derived attribute for an attribute to enable formulation of compact rules with "compressed derived attribute value checking" in the format of IF-CONDITION-THEN-ACTION rules, wherein the logical condition involves checking whether the derived attribute value is available in a set of derived attribute values.

In addition to one or more of the features described above or below, or as an alternative, further embodiments could include that the derived attribute is a derived credential ID and the set of derived attribute values is a collection of intervals of derived credential IDs [min ID, max ID].

In addition to one or more of the features described above or below, or as an alternative, further embodiments could include that the controller executes the rules formulated based on derived attribute values.

In addition to one or more of the features described above or below, or as an alternative, further embodiments could include that the policies are extracted based on at least one of pattern mining, decision trees, and inductive logic programming.

In addition to one or more of the features described above or below, or as an alternative, further embodiments could include that the reader and controller are integrated.

In addition to one or more of the features described above or below, or as an alternative, further embodiments could include a door controller operatively coupled to the controller, the door controller disposed at the door and responsive to commands from the controller to control access to the resource.

Also described herein in an embodiment is a method of encoding of static permissions for real time access control. The method includes extracting a policy from a set of static permissions, receiving a request for access to a resource from a user, the user having a credential including user information stored thereon, the user presenting the credential to request access to a resource protected by a door, and receiving a user information from the credential, wherein the user information includes at least one attribute. The method also includes executing a set of access control rules, the rules based on policies extracted from a database of static permissions for each user defining requirements for permitting access of the user to the resource based on the at least one attribute, and permitting access to the resource if the rules are satisfied, otherwise denying access.

In addition to one or more of the features described above or below, or as an alternative, further embodiments could include the controller receiving context based information from at least one of the reader, a door controller, a server, a cloud based server, another controller, or an administrator.

In addition to one or more of the features described above or below, or as an alternative, further embodiments could include that the executing is based further on the context based information.

In addition to one or more of the features described above or below, or as an alternative, further embodiments could include that the context based information includes information regarding constraints specific to or associated with access to the resource.

Other aspects, features, and techniques of embodiments will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

FIG. 3 depicts a graphical representation of policies being applied to replace static permissions in accordance with an embodiment.

DETAILED DESCRIPTION

Figure 1:
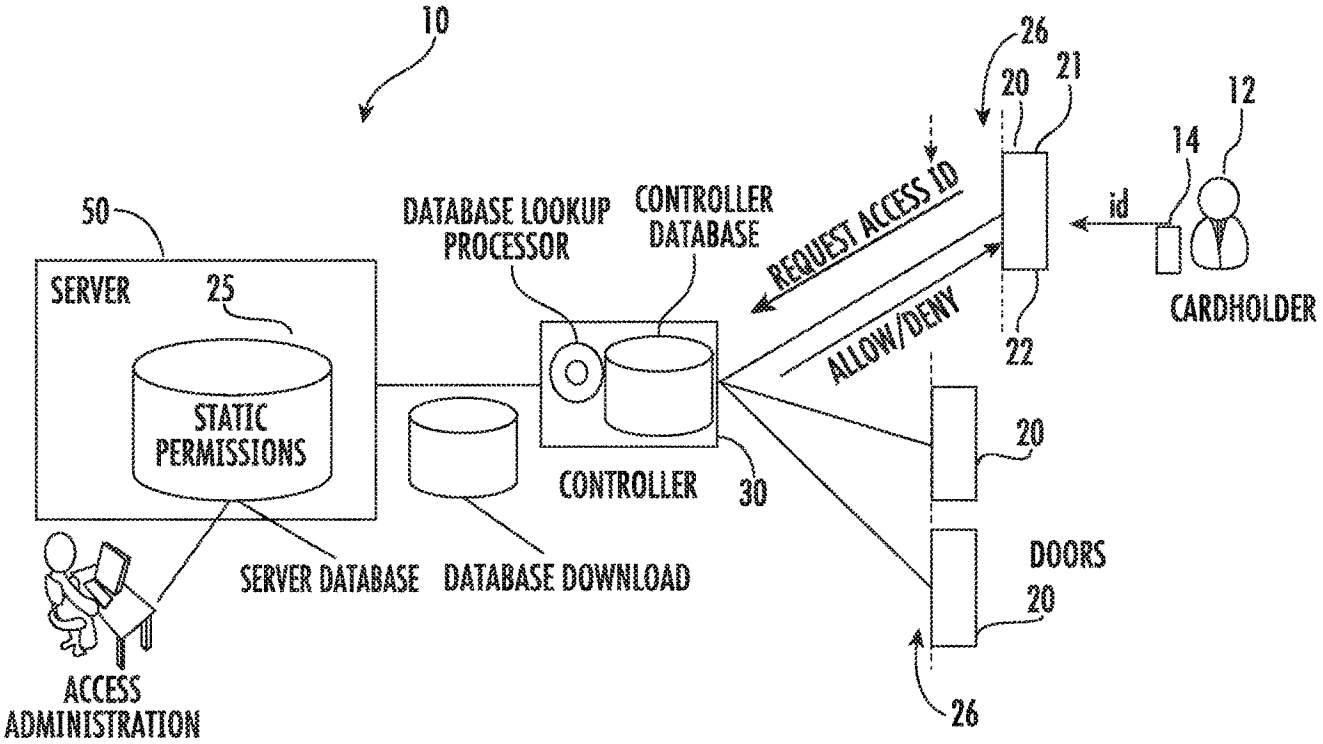
FIG. 1 depicts a standard deployment and operation of a conventional PACS.

In general, embodiments herein relate to migrating conventional access decision mechanisms based on database lookups to a mechanism that requires less memory and processing power without disrupting access administration based on static permissions. The migration is based on shifting the decision making process in a typical Physical Access Control System (PACS) to transform static permissions into equivalent representation based on attribute-based rules. The attribute based rules being compiled into a more efficient representation than the database of static permissions for rapid execution and less resource requirements. These attribute based rules may then be executed by and at a local control panel to make an access decision(s).

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended. The following description is merely illustrative in nature and is not intended to limit the present disclosure, its application or uses. It should be understood that throughout the drawings, corresponding reference numerals indicate like or corresponding parts and features. As used herein, the term controller refers to processing circuitry that may include an application specific integrated circuit (ASIC), an electronic circuit, an electronic processor (shared, dedicated, or group) and memory that executes one or more software or firmware programs, a combinational logic circuit, and/or other suitable interfaces and components that provide the described functionality.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in Figure X may be labeled "Xa" and a similar feature in Figure Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 depicts a relatively standard deployment and operation of a conventional PACS 10. In the figure, a user 12 with a credential 14 (e.g., cardholder) arrives at a reader 22 at a given access point with a lock 21 e.g., locked door 20, gate etc. controlling access to a protected space or resource 26. The user 12 presents the credential 14 (e.g., badge, FOB, or mobile device) which is read by the reader 22 and identification information stored on the credential 14 is accessed and transmitted to a local controller 30. The controller 30 compares the identification information from the credential 14 with a permissions database 25 on the controller 30 to ascertain whether there is a static permission linked to user's credential 14. If the permission(s) are correct, i.e., there is a match, and the particular credential 14 has authorization to access the protected space, the controller 30 then sends a command to the door controller or lock 21 to unlock the door 20 as requested providing the user or requestor 12 access. The controller 30 in this instance, makes an almost immediate decision whether to grant the access (e.g., unlock the door). Users 12 also expect a rapid response, waiting at the access point of access decisions would be very undesirable and wasteful. In a conventional deployment of a PACS, a set of static permission(s) database 25 is maintained at a central server 50. To ensure rapid response when queried, relevant parts of the permissions database on the server 50 are downloaded to individual controllers 30 that control the locks 21 at the doors 20.

In many PACS, such as the access control system 10 shown in FIG. 1, neither the card readers 22 nor the credentials 14 (e.g., access cards) have any appreciable processing, power, or memory themselves. Hence, such card readers 22 and access cards are usually referred to as passive devices. By contrast, the centralized controller 30 and server 50 of the access control system 10 is usually a well-designed and sophisticated device with fail-operational capabilities and advanced hardware and algorithms to perform fast decision making. Moreover, the decision making process of the centralized controller 30 is fundamentally based on performing a lookup of the static permissions 25. The static permissions 25 contains static policy based rules (e.g., one rule might provide that user 12 is not allowed entry into a given room), which change only when the policy changes (e.g., the static permissions 25 might be changed to provide that user 12 can henceforth enjoy the privileges of a given room). Policies are implemented in a set of rules that governs authorization. The static policies as mentioned above can be viewed as context-independent policies and rules. In contrast, context-sensitive policies will require a dynamic evaluation of different states of the PACS 10, building system parameters, other building systems, and external criteria, maybe even including the user's past history of activities. This evaluation is referred to as dynamic authorization.

With such an interconnect architecture as depicted in FIG. 1 and with a reasonable number of users 12 of a protected facility, the PACS 10 using static permissions 25 makes decisions quickly, is reliable, and is considered to be reasonably robust. However, as buildings expand and enterprises expand, the use of the static permissions 25 database can grow and become unwieldy. Furthermore, it is expected that buildings and facilities of the future will require increasingly more intelligent physical access control solutions. For example, access control solutions are being provided with the capability to detect such conditions as intrusion and fire. In general, this increased capability implies that such access control solutions should be provided with the ability to specify conditions that are dynamically evaluated, e.g., disable entry to a particular room in case of a break-in, and/or disable entry to a particular room if its occupancy reaches its capacity limit, and/or allow entry to a normal user only if a supervisor is already present inside the room, etc. This increased capability leads to a significant emphasis on the need for dynamic authorization. That is, if context-sensitive policies form a significant part of the access control policies of a facility, then the facility will appear to adapt its access control enforcement in keeping with the changes in the system. Thus, the facility will appear to be more intelligent as compared to facilities having a lesser number of context dependent, access control policies.

Such dynamic authorization can be centrally implemented with the current architecture (FIG. 1) including modifications and reconfiguration. While this process can work for small facilities, such a centralized solution may not scale up well with an increase in the number of users, size of the facility, or complexity of the policies, especially context sensitive policies, since progressively more and more information will have to be pushed from various sources to the central controller. In particular, a large number of static permissions 25 may need to be defined to account for a variety of combinations of contextual conditions that cannot be represented directly with static permissions 25. For example, this may include for example defining separate permissions for access to a room during emergency, without emergency, while supervisor is in the room, while supervisor is not in the room, while there is emergency and supervisor is in the room, while there is emergency and supervisor is not in the room, and the like. There can be a combinatorial explosion of a number of static permissions 25 that may need to be defined to account for dynamic circumstances.

Figure 2:
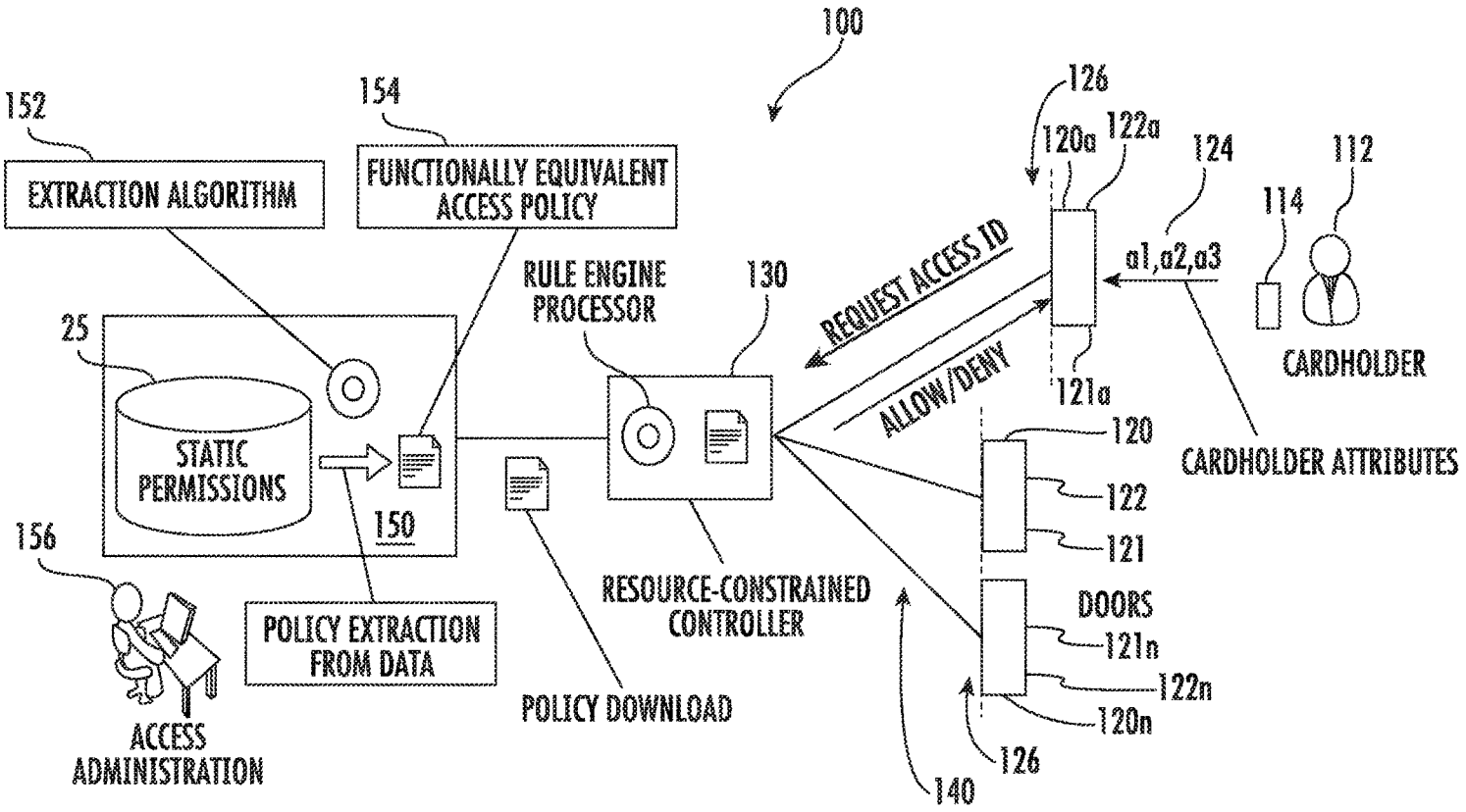
FIG. 2 depicts a deployment and operation of a PACS in accordance with an embodiment.

Turning now to FIG. 2, depicting a deployment and operation of a PACS 100 in accordance with an embodiment. FIG. 2 depicts an access control system 100 using a simpler interconnect architecture and may include readers 122-122*n* (hereinafter just referred to as reader 122) access agents 120*a*-120*n* (e.g., portals such as doors) (herein after just referred to as doors 120) that govern access to a resource 126 (e.g., protected areas such as rooms). The doors 120 are controlled by a door controller 121*a*-121*n* (hereinafter just referred to as door controller 121) that permits the door 120 to be opened and access permitted. The resources 126, for example, may be enclosed spaces or other restricted areas. Access to the resources 126 is permitted by the doors 120 with each of the doors 120 being provided with a corresponding one of the door-controllers 121 to control access through a corresponding one of the doors 120 and into a corresponding one of the resources 126.

The PACS 100 also includes a controller 130 operating as a rule engine processor. Controller 130 executes a rule engine that executes policies 154 or rules 155 which are a relevant subsets of policies 154 downloaded to a controller. It will be appreciated that as used herein rules 155 may be a subset of policies 154, but in some instances the two could be the same. Policies 154 are typically more general for a user 112 or group of users 112, facility, or resource 126, while rules 155 are more specific and may be associated with a specific user 112 or resource 126. For example, the subset of rules 155 taken from policies 154 may be limited only to resources 126 protected by controller 130. Furthermore, the rules 155 may be transformed from their original formulation in 154 to make them more efficiently executed on controller 130. One such transformation may include compilation into a more efficient format suitable for execution, such as a decision diagram or an automaton. As used herein, the terms policies 154 and rules 155 may unless otherwise noted, be used and considered interchange to describe the embodiments. The policies 154 may or may not be context sensitive and dynamic, the operation of which will be described below. In an embodiment the controller 130 is resource constrained. The readers, 122, door controllers or locks 121 and controller 130 are connected to an interconnect or network 140 that is either a wired only network, or a wireless only network, or a mixed wired and wireless network. The PACS 100 may also include a form of a server 150, which may be centrally located or cloud based.

In an embodiment to simplify the architecture of the PACS 100, the framework as described with respect to FIG. 1 is restructured revising the role of the central controller 130 making access control decisions as a result of static permissions downloaded form a server based database. In an embodiment, a more compact, functionally equivalent representation of the same access policies encoded in the static permissions 125 is extracted as depicted at 152 to formulate a functionally equivalent set of access policies 154, from which a relevant subset of the policies 154 or rules 155 is downloaded to controller 130 for execution by the rules engine. This restructured representation links attributes 124 of cardholders 112 requesting access, identifiers of resources 126 to which access is requested (e.g. door IDs), and other contextual parameters (such as time of day) to formulate access control decision making (e.g., allow or deny access at a particular reader 122 and lock 121). Attributes can be general in nature such as a user's 112 as role, badge type etc., but can also include specifics such as badge ID or cardholder ID. Attributes are a generic concept that should be applicable to resource constraints as well, i.e. resources have attributes just as users. Any aspect of a resource (location, voltage, weight, reliability etc.) may be seen as an attribute.

The attributes 124 can be both user specific and generic in nature for an entire group of users 112. Attributes 124 can also be "resource attributes", any attributes 124 specifically associated with a resource 126 and "user attributes," i.e., any attributes specifically associated with a user 112. Other attributes may include, but are not limited to cardholder's building, department, functional role within organization, validity of training that must be taken (e.g. to operate complex machinery controlled by the access mechanism), other certifications, citizenship and export control status which determines access to material subject to international trade and compliance laws etc. Some of the attributes 124 can be "derived" from original attributes 124. For example, some rules 155 that refer to badge ID in order to determine access permissions would be more efficiently expressed if badge ID numbers with the same access rights would be in the same "range" of ID numbers. To accomplish this more efficient representation, we can therefore introduce a new "derived" badge ID attribute, denoted for example as MappedID, by introducing a unique mapping Badge ID→MappedID. For example, if there are 4 individual rules 155 for Badge IDs 123, 45, 65 and 234, the algorithm could map BadgeID→MappedID such as 123→1, 45→2, 65→3 234→4 and creates a rule "IF MappedID is in interval [1, 4] THEN allow access to R&D Lab". If badge ID numbers are remapped, in to a mapped grouping, e.g., (BadgeID→MappedID) a new rules 155 based on the ranges of mapped ID numbers may be employed to define access permissions. Attributes could be derived not only from a single original attribute, but may be derived from multiple other existing attributes.

Furthermore, the rules 155 may be represented in a compact form, such as a finite state automata, including minimal deterministic finite state automata or a decision diagram, including reduced, ordered decision diagrams. The representation of rules 155 into more compact format such as automata or decision diagrams can be achieved using standard techniques for "knowledge compilation" in artificial intelligence domain. Each compiled knowledge representation format (such as automata, decision diagrams, disjunctive negation normal forms etc.) provides equivalent information as original rules 155 but in a more compact or explicit format that allows faster reasoning. For example, in one embodiment, rules 155 are in the form of compiled knowledge representation format using graph traversal algorithms that either reach "accept" node or "deny" node to determine "accept" or "deny" decision for access request. Finally, rules 155 may be combined with traditional database lookups in a hybrid representation, so that execution of rules 155 may be complemented or replaced by standard lookup of permissions based on credential ID.

According to an embodiment, users 112 carry a credential 114, such as RFID cards, smart cards, mobile devices on which a plurality of programmed attributes 124 are stored. The user-carried devices or credentials 114 may have some built in computational capabilities and at least some memory for storing attributes 124, as opposed to conventional passive cards 14 (FIG. 1) that are commonly used today For example, smart cards, mobile devices and the like. Users 112 are required to carry the carried device or credential 114 and present it for access to a secured space or resource 126. While the credentials or user carried devices 114 are more simply referred to herein as smart cards, it should be understood that the embodiments herein my employ to credentials/user-carried devices 114 other than smart cards in particular a mobile device with an app that facilitates the credentialing function. Upon an access request by the user 112, the access decision is made locally by virtue of the interaction between the smart card 114, the reader 122, and the door controller 121, which supplies some context information associated with the particular resource 126 to be accessed. In one embodiment, controller 130 can use the policy, the presented user attributes 124, and both the system context and the user's history in order to make a decision regarding the request for access by the user 112 through the door 120.

It should be appreciated that users 112 would be expected to re-program, reflash, or otherwise alter the attributes 124 stored on their smart cards/credential 114 as needed for updates, or on a predetermined granularity to ensure that they can reflect any changes needed to facilitate correct access within the PACS 100. In specific instances, it may be possible for some components of the PACS 100 to make updates. For example, some door controllers 121 and/or readers 122 may be instructed to reflash/reprogram the attributes 124 of certain users or a group of users 112 by using the readers 122 attached to the door controllers 121 to reflash/reprogram the smart cards 114. In other instance it may be that updates based on a mobile credential 114 are pushed to a user's 112 mobile device. Furthermore, some updates may be made via synchronization to cloud infrastructure or remote servers via standard communication channels based on IP networks.

Continuing with FIG. 2, the readers 122 at the doors 120 or other portals are able to read from and write to the user-carried devices or smart cards 114. The access agents 120 are access control enabled, and are more simply referred to herein as doors 120. However, it should be understood that the present invention relates to access agents other than doors such a gates, turnstiles, elevator access, vehicle access and the like. Each of the doors 120, for example, may be arranged to have one or more readers 122. For example, each of the doors 120 may be arranged to have two readers 122 with one of the readers 122 on each side of the corresponding door 120. Also, each of the doors 120, for example, may be arranged to have a corresponding one of the door controllers 121. The door controller 121 is connected to the reader 122 and has an actuator for locking and unlocking the corresponding door 120. The door controller 121 will usually have a wireless/locally wired communication component and some processing capabilities. Each reader 122 may have its own controller 130 too. Also, the functionality of the door controller 121 and the reader 122 can be folded into one integrated unit as well, and a door 120 may have two such units on either side. In an embodiment as described herein, a resources constrained controller 130 executing a set of policy based rules 155 communicates with a reader 122 and a door controller or lock 121 to permit/deny access to a resource 126. Thus, instead of a central controller 130 storing all permissions as is done in traditional access control systems, the pertinent portions thereof are broken down into policies 154 that are stored on a resource constrained controller 130 in connection with the access control system 100. The readers 122, and door controller 121 communicate with the resource constrained controller 130 in order to choose the rules 155 as a function of a user's presented attributes 124 and hence control access to the resource or room 126.

The interconnect/network 140 interconnects the door controllers 121, readers, 122, and controller 130 and the like and is typically a mix of wired and wireless components, and can leverage the facility IP network. It should be understood that the interconnect 140 may instead comprise only wired components or only wireless components, that the wired components may include regular network cables, optical fibers, electrical wires, or any other type of physical structure over which the door controllers 121, readers 122, controller 130 of the PACS 100 can communicate, and that the wireless components may include RF links, optical links, magnetic links, sonic links, or any other type of wireless link over which the door controllers 121, readers 122, and controller 130 of the PACS 100 can communicate.

The interconnect 140 may be used to transfer system-level information to and program the door-controllers 121 and readers 122. One example of system level information may be administrative actions from an administrator 156, like raising the security level of a facility to high, which need to be communicated to all or to at least some of the door controllers 121 and readers 122. Another example can be local information as collected from different door controllers 121 of a particular room 126 in order to locally compute the room occupancy using the interconnect 140 to talk amongst themselves. Moreover, a log of the various door controllers 121 and readers 122 may also be periodically pushed to a central controller 130 or server 150 using the interconnect 140.

Figure 4:
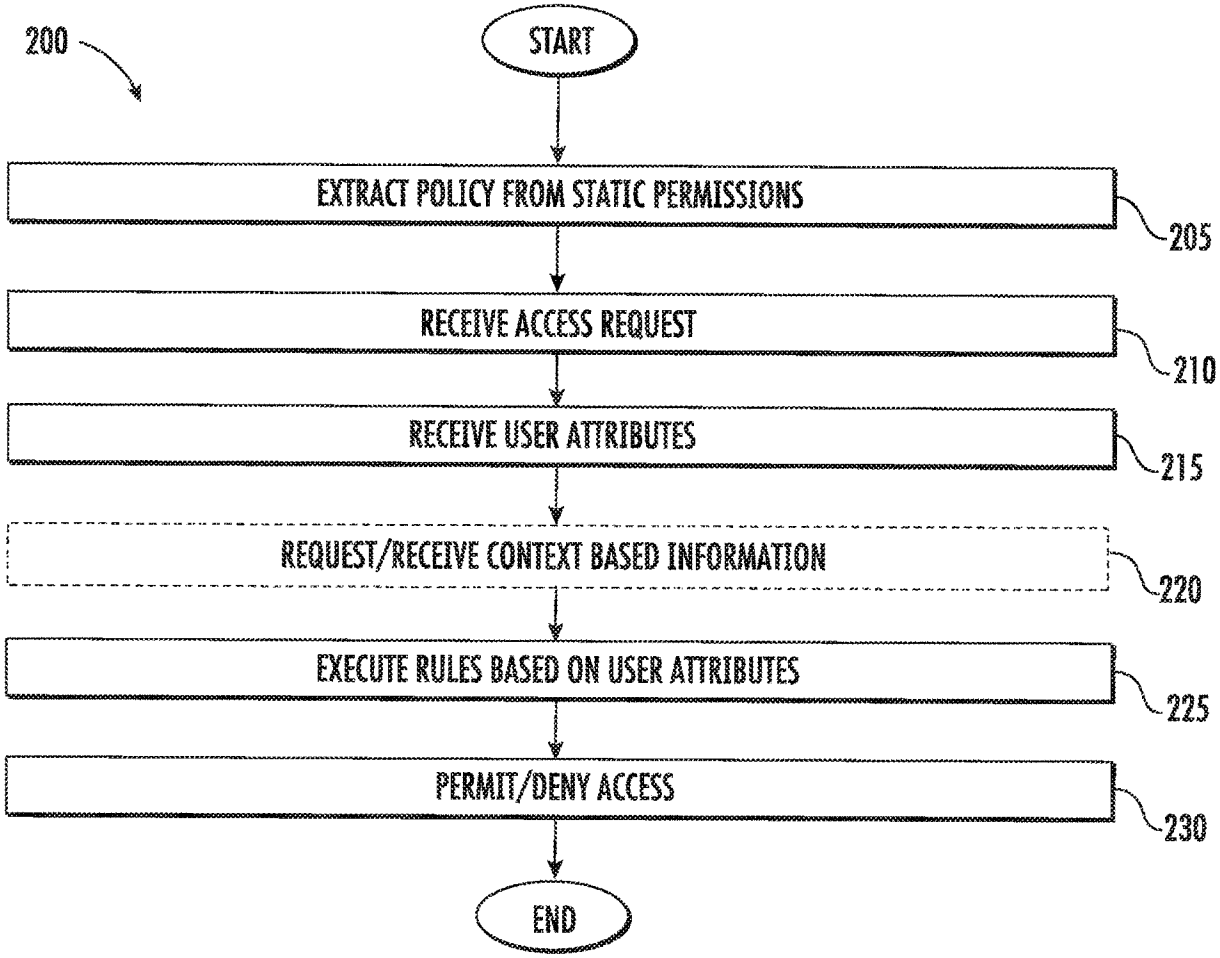
FIG. 4 is a flowchart depicting a methodology of compact encoding of static permissions for real time access control in accordance with an embodiment.

Continuing now with FIG. 2 and turning also to FIGS. 3 & 4, for additional details regarding the generation of the policies 154 from the static permissions 125. FIG. 3 depicts a graphical representation of policies 155 being applied to replace static permissions 125 in accordance with an embodiment. FIG. 4 depicts a flowchart of the methodology 200 of compact encoding of static permissions for real time access control as described herein in an embodiment. The policy extraction 152 may be accomplished on a central server 150 or any other location. It should be noted that the server 150 that includes the static permissions database 125 could be cloud based. The policies 154 may include authorization policies 154 that depend on a system context, e.g., specific information associated with or constraining the physical resource 126, (e.g., refuse entry if the number of people in a room 126 is more than a threshold) and that can be altered dynamically. For example, one policy might provide that a requesting user 112 is allowed access only if the occupancy of the resource 126 is less than or equal to a predetermined capacity limit, such as 20 occupants In such a case, an allow access or deny access decision is dictated by the system context involving the occupancy of the specific room 126. In an embodiment, to implement and enforce context-sensitive policies 154, the controller 130 executes the policy rule-engine instead of a set of static permissions 125. The readers 122 and/or door-controllers 121, by virtue of the interconnect 140, provides a system context. The system context, in conjunction with the rule-engine, is employed by the controller 130 to dynamically makes the access decisions.

According to one embodiment of the present invention, at least a portion of the system context results from the evaluating context. For example, a context may simply be a counter that counts the number of users 112 permitted in the room/resource 126 controlled by the door 120 and door controller 121. In addition the reader 122 or door controller 121 may detect additional or other system contexts to be stored internally and/or transmitted to the controller 130.

Attribute-based policies 154 can be extracted automatically from the database of static-permissions 125. Well known algorithms in the area of pattern mining such as association rule mining, decision trees or inductive logic programming, in which concepts are learned from examples and expressed as logic programs, can be used to extract policies 154 by finding combinations of cardholders' attributes 124 that determine if a cardholder 112 should have or should not have a permission based on the examples from the database of static permissions 125. For example if all the cardholders 112 who have access to R&D Lab are from Department Engineering and have Title Research Scientist, then the algorithm will extract the following rule: "IF Department=Engineering and Title=Research Scientist, THEN allow access to R&D Lab". Note that the policy 154 (set of rules) has to be 100% accurate and cover 100% of the cardholders 112. The accuracy of the rule is computed as percentage of the cardholders 112 that satisfying the condition of the rules (e.g., have Department Engineering and Title Research Scientist), also satisfy the effect of the rule (e.g. have access to R&D Lab). The coverage of a rule 155 or a policy 154 is the percentage of cardholders 112 whose permissions are explained through the rule 154 (e.g., if there are 10 cardholders 112 who have access to R&D Lab and 9 of them have Department Engineering and Title Research Scientist, then, the rule "IF Department=Engineering and Title=Research Scientist THEN allow access to R&D Lab" has 90% of coverage). To ensure the coverage of a policy 154 is 100%, individual rules that cover only one or a few cardholders 112 can be added into the policy 154. Individual rules 155 may contain the cardholders' 112 Badge ID attribute 124 (e.g., IF cardholder ID is 234 THEN allow access to R&D Lab). During the extraction of policies 154, the algorithm aims to extract the minimum number of rules 155 that explain completely the database of static permissions 125. The algorithm also can redefine Badge ID (Badge ID→MappedID) to decrease the number of rules 155 by grouping individual rules 155 in only one. For example, if there are 4 individual rules 155 for Badge IDs 123, 45, 65 and 234, the algorithm could map BadgeID→MappedID such as 123→1, 45→2, 65→3 234→4 and creates a rule "IF MappedID is in interval [1, 4] THEN allow access to R&D Lab".

Continuing with FIGS. 2, 3, and 4, it will be appreciated that the representation format can be in form of standard Attribute-Based Access Control (ABAC) rules, but also in form of decision diagrams, finite state automata and other compiled logical representations. For example, in an embodiment, the rules 155 may be compiled into a graphical finite state diagram. Such a structure is advantageous because it facilitates very fast computation speeds. In implementation, at process step 205 the policies 154 may be established in two ways. First, generating a new representation based on a previously established set of static permissions 125. Second, updates to existing representations, for example, as may be triggered by updates to the permission database (e.g. after performing administration tasks). Further details on the implementation of policies 154 will be presented below. FIG. 3 depicts a graphical representation of rules 155 being applied to replace static permissions 125 in accordance with an embodiment.

In an embodiment the policies may be based on a new or updated representation downloaded to controllers 130. For example, the controllers 130 use an algorithm to compute access decisions either locally based on new representation or inquire server 150 as needed for additional information. In operation, at process step 210 a user 112 presents credential 114 which sends the credential ID, as well as additional user attributes 124, such as Department, Citizenship, etc. Controller 130 receives request for access with cardholder information, such as credential ID and other attributes 124 as depicted at process step 215. Controller 130 first checks if the credential ID (one of the user's attributes 124) is indicated locally as not suitable for local decision making, for example, if the extracted policies are not always able to make the correct decision for the credential holder 112 and cardholder's static permissions 125 are not available locally on controller 130 to make decision via traditional database lookup. The check can be performed, for example, by using a special database for this purpose which we refer to as an exception database. If credential ID is found in the exceptions database, then controller 130 contacts the static permissions server 150 to make the access decision. The controller 130 then also buffers the static permission 125 for this user 112 for updating policies 154 and making the decision locally in future for the same user 112. Thereby reducing the decision time for frequent users in the exceptions database. This could happen either by updating the policies 155 to correctly account for static permissions 125 of the cardholder 112 or by explicitly storing cardholders permissions into a local database. It should be noted that this provides a hybrid approach in which attribute-based policies in combination with traditional database lookups may be employed. Moreover, it should be appreciated that for the purposes of the disclosed embodiments, distinction is not always explicitly made, referring to attribute-based rules and policies since database lookups can be thought of as rules based on single attribute 124—e.g., credential IDs. If credential ID 124 is not included in the exceptions database, the controller 130 checks to see if all required attributes 124 are available from the cardholder to make the decision locally, if not, then controller can either defer the decision making to the static permissions server 150 or contact the server 150 to retrieve additional attributes 124 for the credential ID 124 to make the decision locally. Optionally, as depicted at process step 220 the controller 130 may request any context based information from the reader 122 and door controller 121 to aid in the access decision. Optionally, controller 130 may decide to verify attributes 124 provided by credential 114 by comparing their values with the values stored on the server 150 or some other authoritative source of information as determined by the organization. These checks help ensure integrity of the attribute 124 values stored on the credentials 114 that might have become outdated. The frequency of these verifications can be determined by access administrators 156.

Once the controller 130 has obtained all required attributes 124, and any optional context based information, the controller 130 executes the policy 154 based rules 155 and computes an access decision using attributes, optional context information, and access policy representation stored in the panel as depicted at process step 225. Finally as depicted at process step 230, the decision made by rule engine in controller 130 is used to allow or deny access to the requested resource 126.

In another embodiment, the policies 154 are analyzed in conjunction with a facility topology (not shown), are converted into user-specific rules 155. Moreover, the readers 122 and/or door controllers 121 are also programmed/configured in order for them to evaluate the system context in a distributed manner. The policies 154 are combined with the system context imposed by the door-controllers 121 in order to make access control decisions.

As an example, one of the rules 155 that is produced from the policies 154 might specify that entry into a particular one of the rooms 126 (identified by the facility topology) is allowed only if occupancy in this particular room is less than twenty occupants (e.g., the capacity limit of this room). The context of this policy 154 is the current occupancy of this room 126. The door controller 121, which is charged with imposing the system context, maintains a count of the occupants/users 112 of the room 126. When a user 112 requests access to the room 126, the policy is evaluated by the controller 130 after applying the system context which it receives from the door controller 121 and makes the access decision to grant or deny access. The system context may be received from centralized system as well (from a server, or cloud environment), especially if the context requires aggregating information coming from multiple doors controllers 121 or readers 122 connected to multiple controllers 130.

The policy extraction algorithm 152 may also use the topology of the facility in which the PACS 100 is to be used. In that way, the executable automata may be tailored for this topology. Further, the readers 122 and door controllers 121 may also be programmed/configured in order for them to evaluate the system context in a distributed manner. Accordingly, when a user 112 requests access to a room 126, the corresponding reader 122 transmits the attributes to the controller 130 and the controller 130 initiates execution of those of the policies 154 based on the user's attributes 124 stored in the user's smart card 114 which results in an access decision (allow/deny) that is unique to that user and to that room 126.

In an embodiment, policies 154 may be specified in a formal language and stored as an executable on the resource constrained controller 130. Examples of dynamic policy types that can be specified using the formal logical language may include the following: assisted access, whereby one user 112 can enter the resource 126 only when another designated user 112 is available to provide access; anti-pass back, whereby re-entry is denied if a user is found to have made an unrecorded exit after a valid entry; system state based policies, whereby access is limited, for example, by the number or category of users 112 inside a room 126; and, temporal policies 154, whereby a user 112 has access to a facility only during specific interval of time. Different or other policies may be implemented.

In another embodiment the extraction algorithm 152 analyzes and converts the policies 154 into their equivalent finite state automata. These automata act as rule engines 155 executing the policies 154. They are constructed to allow precisely those behaviors that satisfy the policies 154. All of the policies 154 corresponding to a particular user 112 are collected together and converted into executable automata (rules 155) which are then stored. When the user 112 requests access to a room 126, the corresponding reader transmits the attributes 124 to the controller 130 and it initiates execution of those of the rules 155 based on the policies 154, which results in a an access decision (allow/ deny) that is unique to that user 112. Furthermore, automata may be constructed so not to be unique to the user 112 but rather depend on general attributes 124, such as functional role, department, building, export control status etc. These automata may be applicable to more than one user 112 and would be evaluated for each such user 112.

Accordingly, and particularly with context-sensitive policies, the access control in the PACS 100 is partially decentralized. Thus, there is no need for a controller 130 to centrally maintain information about per-user permissions and system context or to refer to the static permissions database 125 for each access control decision. Instead, access control decisions are made locally, with the resource constrained controllers 130 dynamically maintaining pertinent environmental system context. This de-centralization alleviates the problem of scalability as the number of users 112, enterprises, and the complexity of the policies 154 grow.

Moreover, the access control system 100 is easy to configure and re-configure. At a high level, the readers 122 and/or the door controllers 121 are equipped with the knowledge of what they are protecting, but not how they are protecting and how should they interact and compose the system context, but not with details about an user's attributes 124 or history of activities. The readers 122 and/or door controllers 121 are stateless in this regard, making reconfiguration of the facility easier.

While secure authorization is not the primary focus of the present invention, existing mechanisms can be used for a basic secure solution. For example, using symmetric key encryption, where all the access agents and the administrator 156 share a secret key k, with which they will be configured at the time of installation (or on a subsequent facility-wide reset operation, if the key is compromised), the per-user policy engine and states can be encrypted with k on the user-carried devices, and the readers 122 and/or the door controllers 121 can decrypt them using k and further write back encrypted states using k on the smartcard 114. This symmetric key encryption ensures security as long as k is not compromised. The policy on the smart card can be certified by a digital certificate and its validity can be verified by using conventional verification services.

The system context may be detected by individual door controllers 121 through sensors either built into the door controllers 121 or otherwise connected to components of the PACS 100. An example of this can be the presence of a certain chemical in a room 126. The system context may also require the collaboration of different door controllers 121 e.g., to decide if the occupancy of a room 126 is below a certain threshold. Such contexts, along with each of the individual grants/denials to users 112 are all represented as discrete events happening at the respective controller 130 or door controllers 121. The policy specification language can also define hierarchical events which are formed out of individual events at different controllers 130 or 121. For example, if event e1 represents the context of "high threshold of a chemical in room A" and event e2 represents the context of "occupancy in room A>=1", then the event e3 defined as "e1 AND e2" represents the system context "personnel hazard in room A". Such events may be specified as part of the policies 154. The extraction algorithm 152 can then translate the event definitions to specific actions on the part of the door controllers 121 by which they will detect system context either individually or in collaboration, as required by the policies 154.

Moreover, as discussed above, the interconnect 140 may include the administrator 156. The system administrator 156 may be used to supply special system contexts that are in addition to any system contexts. Such special system contexts, for example, may be used to take care of emergency situations including but not limited to revoking the access rights of a rogue user. Also, the system administrator 156 may be arranged to formally specify policy roles as the policies relate to each user 112 and to assign the users to appropriate ones of these roles.

Usually the policies will not differ across every individual user 112, but are likely to be different across groups of users 112. In this sense, a role refers to a special attribute 124 that is of key importance for a certain policy or groups of policies 154 that is applicable to a certain class of user 112. For example, a "supervisor" is a role that can is applicable to the policy 154 of free access to all rooms 126, whereas a "regular employee" can be a role that includes policies 154 which allow an entry to certain protected rooms 126 only if a "supervisor" is present. For example, the access control system 100 may also include user-specific authorization policies 154. An example of this can be a special user 112 who is not a regular employee at a site but needs better structured access control policies 154 as compared to a user 112 that is identified as a visitor.

Physical Access Control Systems 100 need less expensive installations to enforce policies using compact representations. This leads to cheaper installations of PACS 100 for new users 112 or reduced frequency and costs of upgrades for existing customers, who would need to install less additional intelligent controllers 130 due to better usage of available resources. The described embodiments permit reducing the number of cardholder IDs stored on the local controller 130 by using cardholder attributes 124 for making decisions for majority of users 112. Similarly, it also reduces the number of access levels stored locally at the controller 130.

The terminology used herein is for the purpose of describing particular embodiments only and is not intended to be limiting. While the description has been presented for purposes of illustration and description, it is not intended to be exhaustive or limited to the form disclosed. Many modifications, variations, alterations, substitutions, or equivalent arrangement not hereto described will be apparent to those of ordinary skill in the art without departing from the scope of the disclosure. Additionally, while the various embodiments have been described, it is to be understood that aspects may include only some of the described embodiments. Accordingly, embodiments are not to be seen as being limited by the foregoing description, but is only limited by the scope of the appended claims.

The invention claimed is:

1. A physical access control system for protecting a resource, comprising:

a credential including information regarding a user stored thereon, the credential presented to request access to a resource protected by an access point;

a reader in operative communication with the credential and configured to read the user information from the credential, wherein the user information includes at least one attribute;

a server storing a database of static permissions, the static permissions linked to individual user credentials, the server configured to execute a policy extraction algorithm to derive policies from the database of static permissions, the policies including access control data for a group of users, the server sending the policies to a controller;

the controller executing a set of access control rules, the rules based on the policies extracted from the database of static permissions by the server, the policies defining requirements for permitting access of the user to the resource based on the at least one attribute, the controller configured to permit or deny access to the resource upon the rules providing a decision whether the user can access the resource or not;

upon the rules not providing the decision whether the user can access the resource or not, the controller accessing an exception database to determine if the credential is stored in the exception database;

upon the credential being stored in the exception database, the controller accessing the server, the server permitting or denying access to the resource based on the database of static permissions.

2. The physical access control system of claim 1, further comprising the controller receiving context based information from at least one of the reader, a door controller, another controller, and an administrator.

3. The physical access control system of claim 2, wherein the executing is based on the context based information.

4. The physical access control system of claim 2, wherein the context based information includes information regarding attributes specific to or associated with access to the resource.

5. The physical access control system of claim 4, wherein context based information includes at least one of occupancy of a resource, a maximum occupancy of a resource, a time based constraint, a user based constraint, user history, a PACS constraint, a building system parameters, a parameter of other building systems, and external criteria.

6. The physical access control system of claim 1, wherein the credential is at least one of a badge, a magnetic card, an RFID card, a smart card, a FOB, and a mobile device.

7. The physical access control system of claim 1, wherein the attribute is specific to the user.

8. The physical access control system of claim 1, wherein the attribute is generic to a group of users.

9. The physical access control system of claim 1, wherein the attribute is at least one of a user's role, a user's department, a user's export control status, a user's certification/training status, a badge type, and a credential ID.

10. The physical access control system of claim 1, wherein the controller executes the policy on controller using at least one of a standard Attribute-Based Access Control policy execution mechanisms and an IF-CONDITION-THEN-ACTION rule, wherein each condition of the rule is a logical relationship over user and resource attribute values and action of the rule is to permit or deny access to the resource.

11. The physical access control system of claim 1, wherein the controller executes the rules in a compiled knowledge representation format using graphical traversal algorithms.

12. The physical access control system of claim 1, wherein the system computes a derived attribute for an attribute to enable formulation of compact rules with "compressed derived attribute value checking" in the format of IF-CONDITION-THEN-ACTION rules, wherein the logical condition involves checking whether the derived attribute value is available in a set of derived attribute values.

13. The physical access control system of claim 12, wherein the derived attribute is a derived credential ID and the set of derived attribute values is a collection of intervals of derived credential IDs [min ID, max ID].

14. The physical access control system of claim 13, wherein the controller executes the rules formulated based on derived attribute values.

15. The physical access control system of claim 1, wherein the policies are extracted based on at least one of pattern mining, decision trees, and inductive logic programming.

16. The physical access control system of claim 1, wherein the reader and controller are integrated.

17. The physical access control system of claim 1, further including a door controller operatively coupled to the controller, the door controller disposed at the door and responsive to commands from the controller to control access to the resource.

18. A method of encoding of static permissions for real time access control, the method comprising:

extracting a policy from a set of static permissions, the static permissions linked to individual user credentials, the extracting including executing a policy extraction algorithm to derive policies from the set of static permissions, the policies including access control data for a group of users;

receiving a request for access to a resource from a user, the user having a credential including user information stored thereon, the user presenting the credential to request access to a resource protected by an access point;

receiving a user information from the credential, wherein the user information includes at least one attribute;

executing a set of access control rules, the rules based on the policies extracted from the set of static permissions, the rules defining requirements for permitting or denying access of the user to the resource based on the at least one attribute upon the rules providing a decision whether the user can access the resource or not; and permitting access to the resource if the rules are satisfied, otherwise denying access;

upon the rules not providing the decision whether the user can access the resource or not, accessing an exception database to determine if the credential is stored in the exception database;

upon the credential being stored in the exception database, accessing the server, the server permitting or denying access to the resource based on the database of static permissions.

19. The method of encoding of static permission for real time access control of claim 18, further comprising the controller receiving context based information from at least one of the reader, a door controller, a server, a cloud based server, another controller, or an administrator.

20. The method of encoding of static permission for real time access control of claim 18, wherein the executing is based further on the context based information.

21. The method of encoding of static permission for real time access control of claim 20, wherein the context based information includes information regarding constraints specific to or associated with access to the resource.

22. The method of encoding of static permission for real time access control of claim 18, wherein the policies are based on an IF-CONDITION-THEN-ACTION rule, wherein each condition of the rule is a logical relationship over user and resource attribute values and action of the rule is to permit or deny access to the resource.

23. The method of encoding of static permission for real time access control of claim 18, wherein the rules are in a compiled knowledge representation format using graphical traversal algorithms.

24. The method of encoding of static permission for real time access control of claim 18, wherein the extracting is based on at least one of pattern mining, decision trees, and inductive logic programming.

* * * * *